US011903500B2

(12) United States Patent
Huffman et al.

(10) Patent No.: US 11,903,500 B2
(45) Date of Patent: Feb. 20, 2024

(54) FRAME FOR DISPLAYING AN IMAGE

(71) Applicant: Tracer Imaging LLC, Ossining, NY (US)

(72) Inventors: Jessica Huffman, Wilton, CT (US); Ryan Kelly, Scarsdale, NY (US); Steven M. Spiro, Chappaqua, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 17/955,948

(22) Filed: Sep. 29, 2022

(65) Prior Publication Data

US 2023/0109420 A1 Apr. 6, 2023

Related U.S. Application Data

(60) Provisional application No. 63/251,331, filed on Oct. 1, 2021.

(51) Int. Cl.
*A47G 1/06* (2006.01)
*A47G 1/10* (2006.01)

(52) U.S. Cl.
CPC ..... *A47G 1/0605* (2013.01); *A47G 1/101* (2019.08); *A47G 2001/0677* (2013.01)

(58) Field of Classification Search
CPC ..... A47G 1/0605; A47G 1/101; A47G 2001/0677
See application file for complete search history.

(56) References Cited

U.S. PATENT DOCUMENTS

| | | | | |
|---|---|---|---|---|
| 1,702,626 | A * | 2/1929 | Beyrle | A47G 1/10 40/783 |
| 1,710,429 | A * | 4/1929 | Mobley | G09F 1/12 40/781 |
| 4,027,413 | A * | 6/1977 | Moede | B44D 3/185 40/792 |
| 6,962,017 | B1 * | 11/2005 | Pounds | G09F 1/12 40/781 |
| 10,813,478 | B2 | 10/2020 | Spiro et al. | |
| 2004/0205993 | A1 * | 10/2004 | Olson | A47G 1/10 40/783 |
| 2005/0155267 | A1 * | 7/2005 | Hamilton | A47G 1/065 40/734 |
| 2010/0263251 | A1 * | 10/2010 | Pitcher | G09F 7/18 40/768 |

* cited by examiner

*Primary Examiner* — Cassandra Davis
(74) *Attorney, Agent, or Firm* — Leason Ellis LLP

(57) ABSTRACT

In one embodiment, a frame assembly includes a mitered frame base including a plurality of rail sections that are joined together in corners of the mitered frame base by a plurality of fasteners. Each rail section includes a first surface for receiving a layered image arrangement. The frame assembly also includes a plurality of mitered splines that are configured to snap-fittingly mate with the plurality of rail sections. Each spline having a second surface that faces the first surface of one of the respective rail sections for securing the layered image arrangement between the spline and the rail section. A corner gap is formed between ends of respective mitered splines in each corner of the frame assembly. A plurality of corner pieces are received within the corner gaps to complete the frame assembly, the plurality of corner pieces snap-fittingly engaging the plurality of rails sections.

24 Claims, 8 Drawing Sheets

FRAME FOR DISPLAYING AN IMAGE

CROSS-REFERENCE TO RELATED APPLICATION

The present application claims priority to and the benefit of U.S. patent application Ser. No. 63/251,331, filed Oct. 1, 2021, which is hereby incorporated by reference in its entirety.

Additional details concerning the present framing system and exemplary equipment for the assembly thereof are set forth in U.S. Pat. No. 10,813,478, (the '478 patent) which is hereby incorporated by reference in its entirety.

BACKGROUND

The idea of entrapping a flat item between two sheets of transparent material is likely nearly as old as the invention of sheet glass. The present invention describes novel structures that allow a printed image, in particular, to be readily located and held between two transparent sheets that are, in turn, held within a frame.

In a conventional construction, the pressure between two sheets of glass pinches the image in position, and the paired sheets of glass are then fixed within, for example, a rabbet in the back of a wooden picture frame. The image then appears to float ahead against any ambient background, often with the open glass surrounding area serving cosmetically in place of an opaque picture mat.

This configuration produces a pleasing appearance, but poses a number of challenges. First, glass sheet dangerous to handle, and is subject to impact or breakage from impact or from a fall. Second, an image with a transparent surround allows the inside of the frame to be seen, which places constraints on how the frames can be attractively assembled and finished. Third, it is difficult to secure the paired sheets reliably to one another, given seasonal fluctuations in common dimensional materials such as wood moldings.

SUMMARY

In one embodiment, a frame assembly includes a mitered frame base including a plurality of rail sections that are joined together in corners of the mitered frame base by a plurality of fasteners. Each rail section includes a first surface for receiving a layered image arrangement. The frame assembly also includes a plurality of mitered splines that are configured to snap-fittingly mate with the plurality of rail sections. Each spline having a second surface that faces the first surface of one of the respective rail sections for securing the layered image arrangement between the spline and the rail section. A corner gap is formed between ends of respective mitered splines in each corner of the frame assembly. A plurality of corner pieces are received within the corner gaps to complete the frame assembly, the plurality of corner pieces snap-fittingly engaging the plurality of rails sections.

BRIEF DESCRIPTION OF THE DRAWING FIGURES

The present invention may be appreciated by reference to the following descriptions and drawings, in which.

DETAILED DESCRIPTION OF CERTAIN EMBODIMENTS

Figure 1:
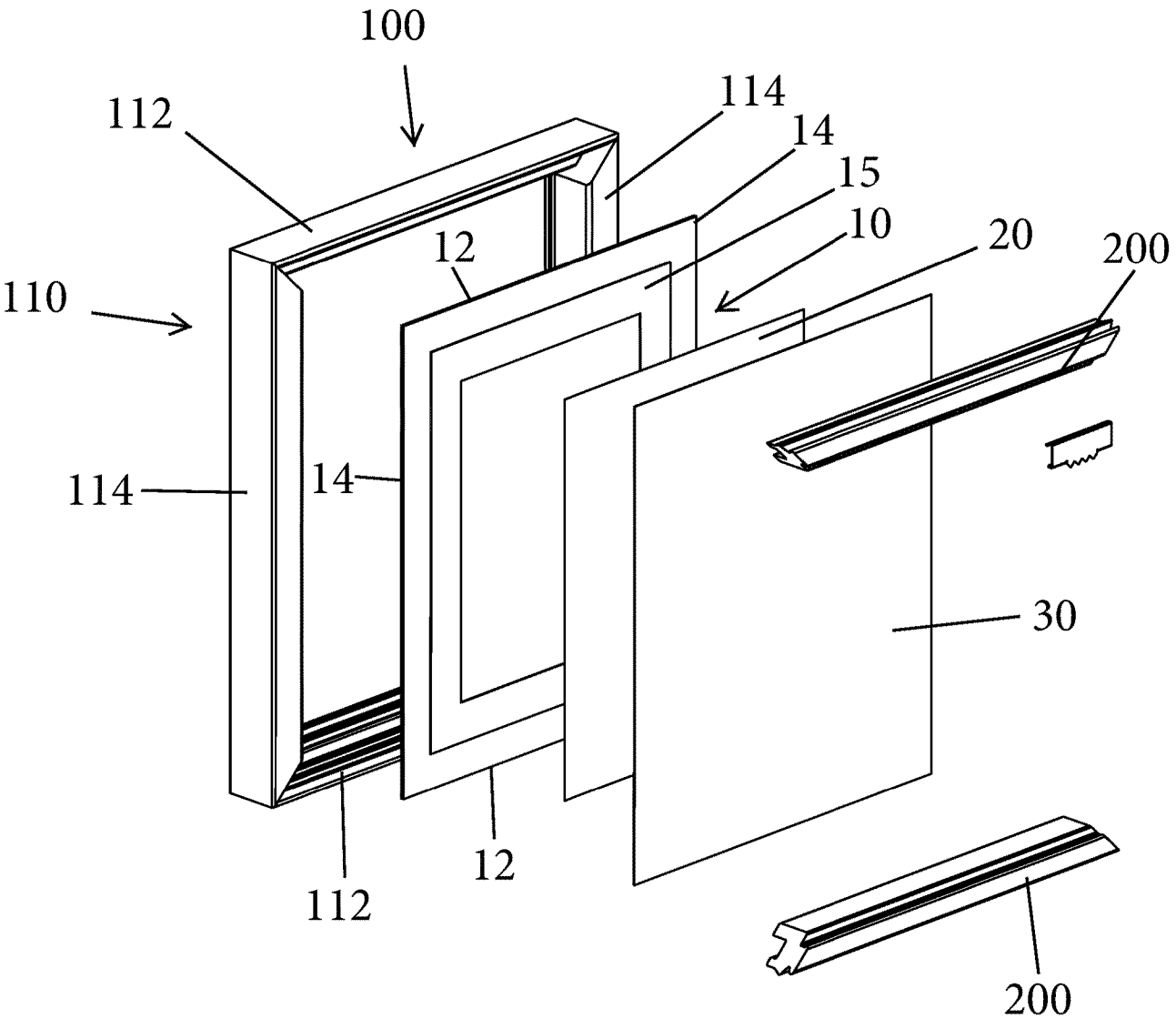
FIG. 1 is an exploded view of the major elements of one frame according to one embodiment.

FIG. 1 is an exploded perspective view of a complete frame assembly 100 showing the various parts. As mentioned, certain basic details of the frame assembly 100 are disclosed in the '478 patent. The frame assembly 100 includes a base frame 110 which can comprise a preassembled mitered frame that can be formed using four mitered sections of frame stock having the profiles illustrated in the figures. The base frame 110 includes base rail sections that are represented in the illustrated exemplary rectangular base frame 110 by a pair of opposing first rails 112 (short mitered rails) and a pair of opposing second rails 114 (long mitered rails). Mitered corners are joined here using traditional techniques, such as the use of V-nails. Since the illustrated frame is rectangular, the rails can be discussed as short and long; however, in a square frame, the rails have the same lengths.

The complete the frame assembly 100, it also includes a plurality of splines 200 that are complementary to and engage at least one of: the pair of first rails 112 or the pair of second rails 114.

It will be understood that in other embodiments, a non-mitered construction can used to form the base frame 110 having the characteristics described herein.

As described below and in contrast to the rails disclosed in the '478 patent, the first and second rails 112, 114 have different constructions since they function differently. It will also be appreciated that the features described below with respect to the first and second rails 112, 114 can be reversed in that features of the first rails 112 illustrated in FIGS. 1-6 can instead be incorporated into the second rails 114 and similarly, the features of the second rails 114 illustrated in FIGS. 1-6 can instead be incorporated into the first rails 112.

First Rails 112 (Short Mitered Rails)

Figures 2, 3, 4:
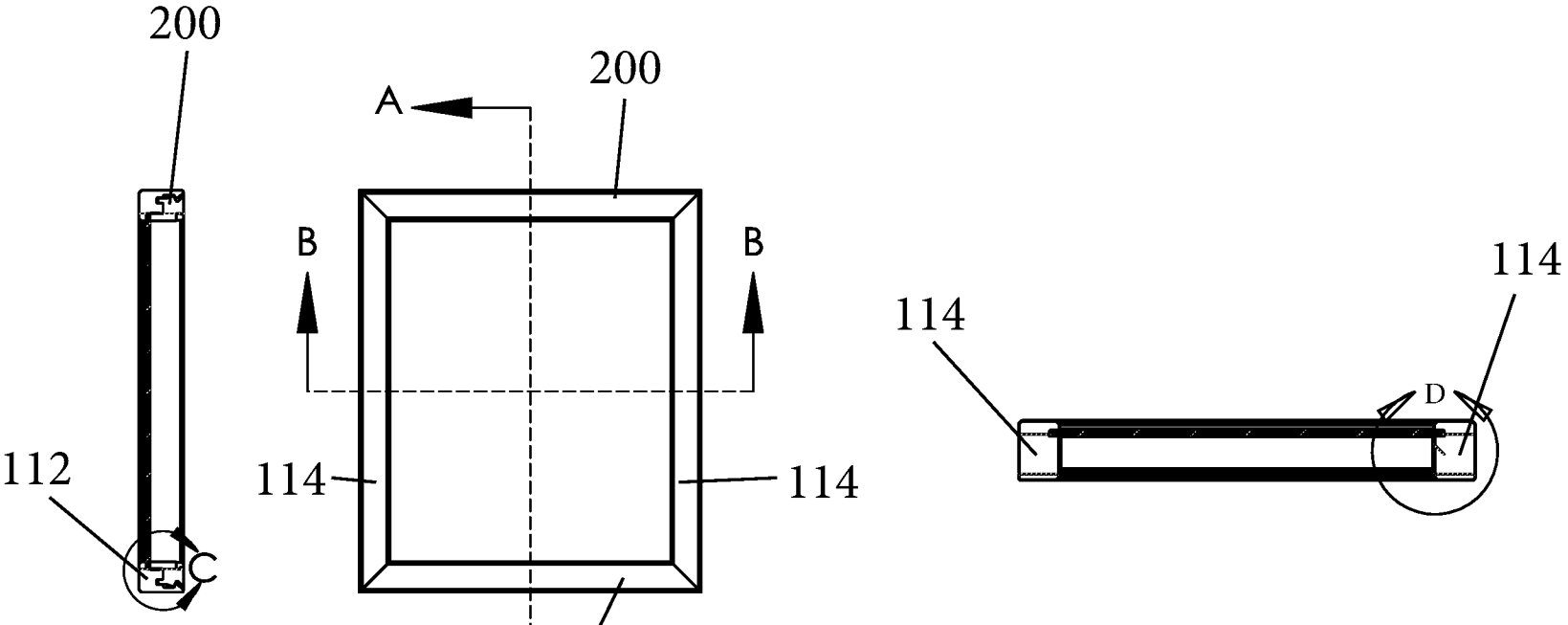
FIG. 2 is a top plan view of the assembled frame.
FIG. 3 is cross-sectional view taken along the line A-A of FIG. 2.
FIG. 4 is a cross-sectional view taken along the line B-B of FIG. 2.
Figure 5:
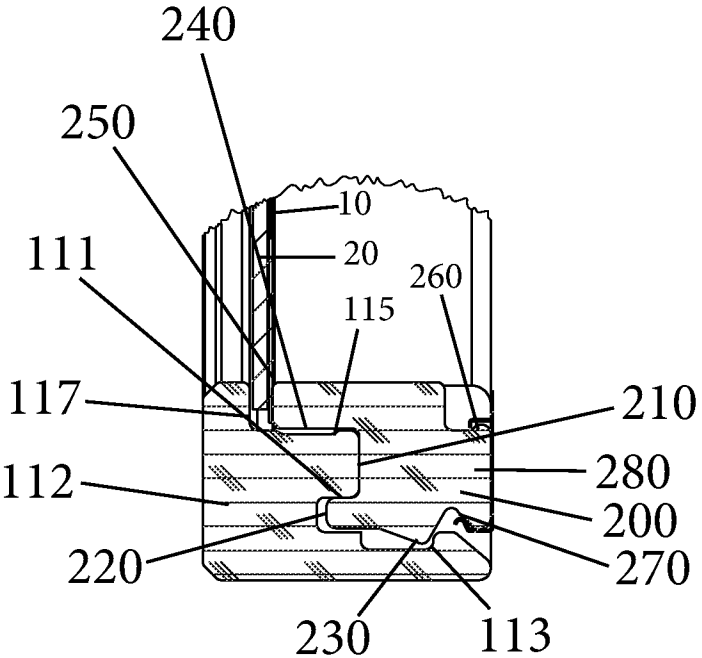
FIG. 5 is an enlarged section view C taken from FIG. 3.

FIGS. 3 and 5 best illustrate one exemplary construction of the first rails 112. Each of the first rails 112 is configured to engage and attach to one spline 200 to form a completed, finished side of the frame assembly.

In one embodiment, each of the first rail 112 and the spline 200 has the same construction of the rails and splines discussed and illustrated in the '478 patent. For example, the first rail 112 includes a dado 111, a retainer lip 113, a compression ridge 115 and as retaining rabbet 117. By reference to FIG. 5, compatible features may be found on frame spline stock 200, including spline stop land 210, spline guide ridge 220, spline engagement ridge 230, spline compression face 240, spline stack retention face 250, spline backer retention lip 260, and angled spline lifting face 270. It may be appreciated by particular reference to FIG. 5 that the relief features of the lightly engaged parts acts as a guide, so that the application of mechanical force to spline top face 280 of spline 200, when the first rail 112 is securely held and stationary, induces guided mechanical engagement between the compatible features of the first rail 112 and the spline 200. FIG. 5 thus shows the assembled state of the first rail 112 and the spline 200. The first rail 112 and the spline 200 interlock in the manner described in the '478 patent.

Second Rails 114 (Long Mitered Rails)

The second rails 114 can have different constructions relative to the first rails 112 and more particularly, the second rails 114 can have a finished look and are not designed to engage and interlock with splines 200.

Figure 6:
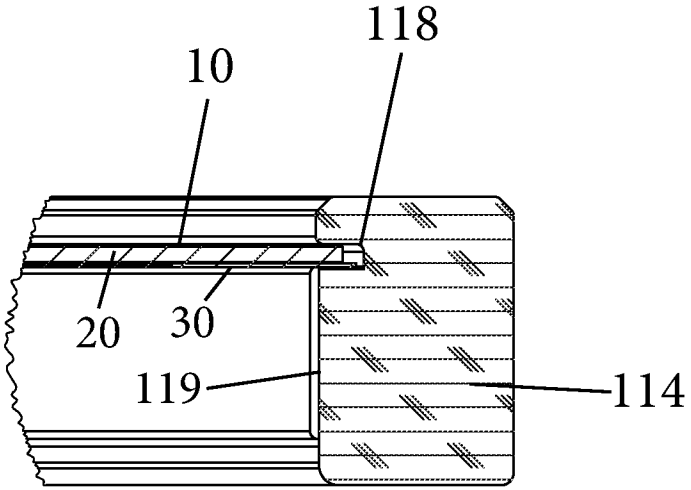
FIG. 6 is an enlarged section view D taken from FIG. 4.

The second rail 114 is best shown in FIGS. 4 and 6. As shown, the prominent feature of the second rail 114 is the inclusion of a channel or groove 118 formed along an inner surface or inner face 119 thereof. As described in more detail below, the channel 118 is coplanar with the space formed between the retaining rabbet 117 and the spline stack retention face 250. This coplanar space defined along the four sides of the frame assembly receives the image to be displayed which, as described below, is typically in the form of a layered display image.

Alternative Frame Construction

In an alternative embodiment, the second rails 114 have the same construction as the first rails 112 and therefore, four splines 200 are used to define the channel that receives two opposing sides of the layered display image. This construction is shown in FIGS. 7-14.

Display Image

As mentioned, the frame 100 is designed to display an image, such as a print, photo or any other substrate suitable for display in a frame. As discussed herein, the display image is formed of several discrete structures (layers) that are combined to form a layered display image.

Instead of using a glass sheet as disclosed in the '478 patent, the present disclosure teaches the use of a transparent front substrate in the form of a transparent flexible front plastic sheet 10. The front sheet 10 can be formed of any number of different suitable plastic materials that are freely flexible. The front sheet 10 can have different shapes and sizes; however, front sheet 10 is typically a parallelogram, such as a rectangle, that is defined by a pair of opposite first sides 12 and a pair of opposite second sides 14.

In one aspect of the present disclosure the front sheet 10 can include a preformed mat 15 that extends around the peripheral edge of the front sheet 10. The preformed mat 15 can be in the form of a preprinted mat that is printed on one face of the front sheet 10. As is known, a traditional mat is usually a thin, flat piece of paper-based material included within a picture frame, which serves as additional decoration and to perform several other, more practical functions, such as separating the art from the glass. The size of the mat 15 can be selected in view of the desired appearance of the framed object. The transparent space of the front sheet 10 between the sides of the mat 15 is the display area in which the image to be displayed is positioned.

An image substrate 20, such as a print or photo, is also provided and is displayed behind the front sheet 10. As described herein, the image substrate 20 can have a size (dimensions) smaller than the front sheet 10.

Figure 7:
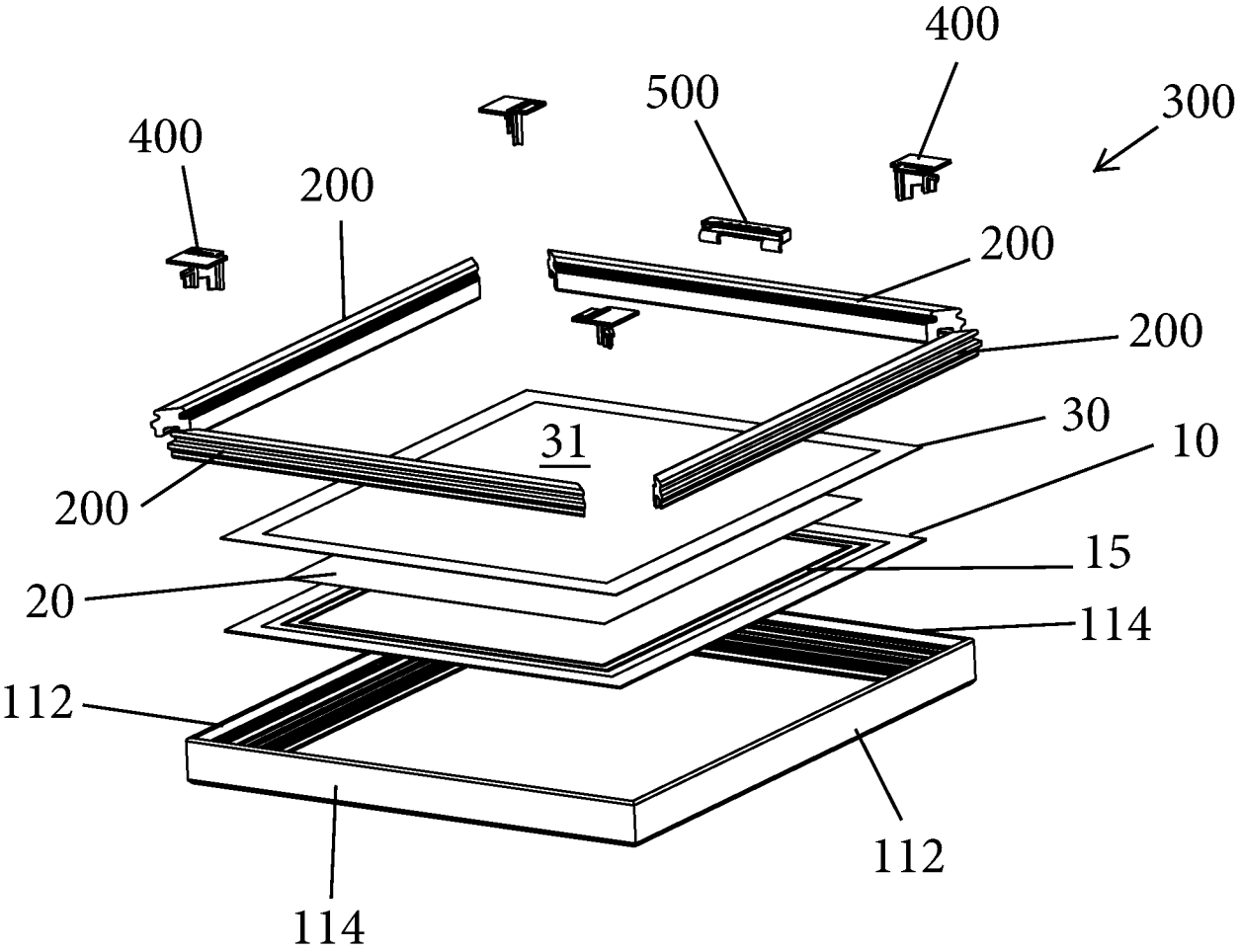
FIG. 7 is an exploded view of the major elements of one frame according to another embodiment.
Figure 8:
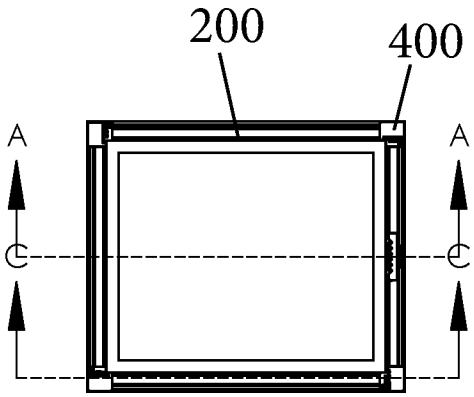
FIG. 8 is a top plan view of the assembled frame of FIG. 7.
Figure 9:
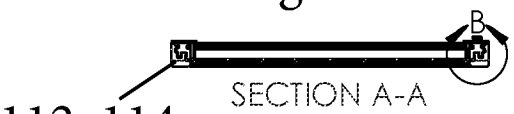
FIG. 9 is a cross-sectional view taken along line A-A of FIG. 8.
Figure 11:
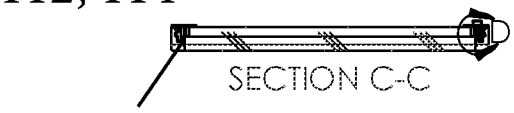
FIG. 11 is a cross-sectional view taken along line B-B of FIG. 8.

A rear sheet or back plate 30 is provided and is intended to cover the rear of the image substrate 20. The rear sheet 30 can be different than the front sheet 10 or it can be the same in that both the front sheet 10 and the rear sheet 30 can be in the form of transparent flexible plastic sheets. However, since this structure is placed along the rear of the image substrate 20, the rear sheet 30 can be opaque. In particular, as best shown in FIG. 7, the center region 31 of the rear sheet 30 can be opaque, while the peripheral border can be transparent. The center region 31 can be a layer of ink that is deposited (e.g., printed) onto a transparent (PET) sheet that comprises the rear sheet 30. This opaque center region 31 is preferably sized to at least substantially cover the mat 15 and thus covers the image 20 as well and thus, when reviewed from the rear, neither the image 20 nor the mat 15 are visible through the transparent rear sheet 30.

As discussed herein, the combined front sheet 10, image substrate 20 and the rear sheet 30 can define a combined or layered image arrangement that is held within the surrounding frame.

Assembly of Display Image within the Frame

The flexible front sheet 10 that optionally has mat 15 as a part thereof is first inserted into the channel 118 formed in each of the second rails 114. For example, one second side 14 of the front sheet 10 is inserted into one channel 118 formed in one second rail 114. The front sheet 110 is then flexed so that the opposite other second side 14 can be inserted into the other channel 118 formed in the opposing second rail 114. Once the front sheet 110 is received into the opposing channels 118, the front sheet 110 is allowed to flex back to its normal flat, planer state. In this flat state, the second sides 114 are captured within the channels 118, while the first sides 12 are disposed over the planar retaining rabbets 117 (one opposite sides of the frame) which can be thought of as defining a landing on which the opposing first sides 12 rest.

The image 20 is then laid over the rear face of the front sheet 110 and positioned within the transparent area between the mat 15. Next, the image 20 is secured to the front sheet 10 using conventional techniques, such as by bonding or using adhesives. More particularly, adhesive tape can be used. Edges of the image 20 are taped to the front sheet 10 and the presence of the mat 15 hides such tape segments along the sides of the image 20. In other words, the tape segments are located along the rear face of the front sheet 110 within the area of the mat 15 and therefore are not visible from the front.

To complete and finish the frame 100 and retain the layered image arrangement within the frame, splines 200 are engaged to the two first rails 112 resulting in the spline stack retention face 250 being placed in contact with the front sheet 110 and the layered image arrangement being pinched between the spline stack retention face 250 and the planar retaining rabbet 117. Tools described in the '478 patent can be used to attach the splines 200 to the first rails 112 to complete the finished frame 100.

The completed frame 100 can be hung using conventional hardware.

Frame Assembly (FIGS. 7-14)

FIGS. 7-14 illustrate a complete frame assembly 300 according to another embodiment. FIG. 7 is an exploded perspective view of the complete frame assembly 300 showing the various parts. As mentioned, certain basic details of the frame assembly 300 are disclosed in the '478 patent. The frame assembly 300 includes the base frame 110 which can comprise a preassembled mitered frame that can be formed using four mitered sections of frame stock having the profiles illustrated in the figures. As previously mentioned, the base frame 110 includes base rail sections that are represented in the illustrated exemplary rectangular base frame 110 by a pair of opposing first rails 112 (short mitered rails) and a pair of opposing second rails 114 (long mitered rails). In other words, the ends of each of the first rails 112 and second rails 114 have mitered ends (angled as opposed to ends that are perpendicular to the longitudinal axis of the rail). Mitered corners are joined here using traditional techniques, such as the use of V-nails. Since the illustrated frame is rectangular, the rails can be discussed as short and long; however, in a square frame, the rails have the same lengths.

Similar to the assembly 100, the complete the frame assembly 300 also includes a plurality of splines 200 that are complementary to and engage the first rails 112 and the second rails 114. Unlike the first embodiment (assembly 100), in the assembly 300, four splines 200 are used to engage and lock in place with the first and second rails 112, 114.

It will be understood that in other embodiments, a non-mitered construction can used to form the base frame 110 having the characteristics described herein.

Figure 10:
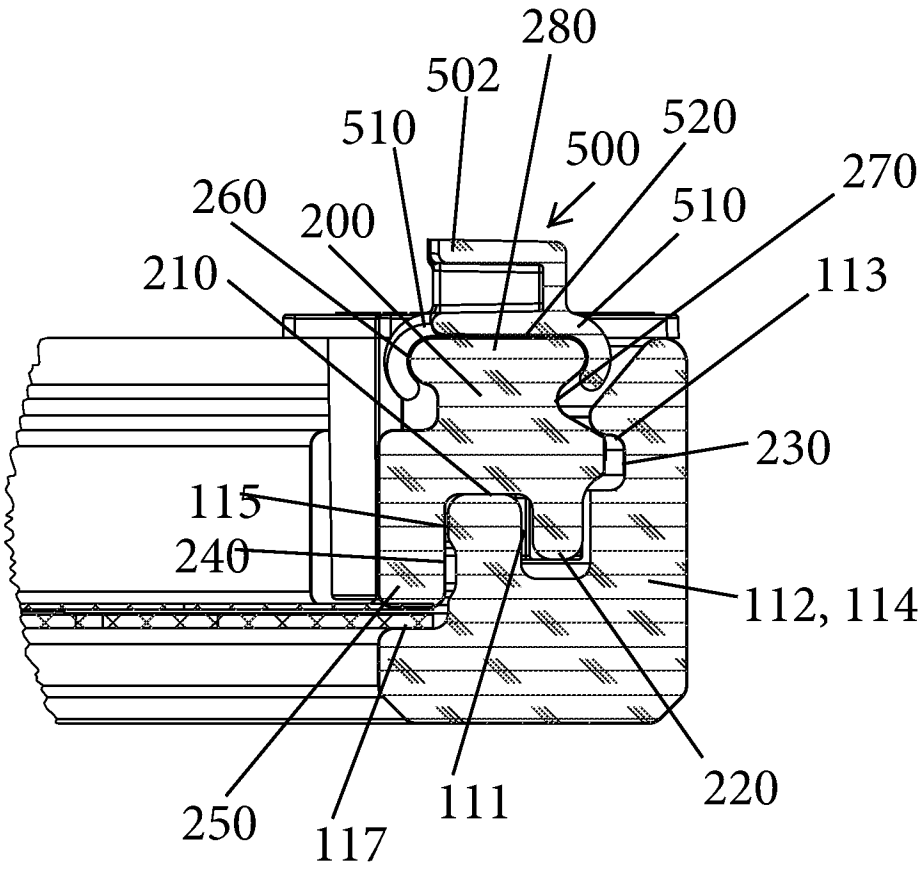
FIG. 10 is an enlarged cross-sectional view taken from FIG. 9.

In one embodiment, each of the first rail 112 and the second rail 114 and the spline 200 have the same construction of the rails and splines. For example, each of the first rail 112 and the second rail 114 includes a dado 111, a retainer lip 113, a compression ridge 115 and as retaining rabbet 117. By reference to FIG. 10, compatible features may be found on frame spline stock 200, including spline stop land 210, spline guide ridge 220, spline engagement ridge 230, spline compression face 240, spline stack retention face 250, spline backer retention lip 260, and angled spline lifting face 270. It may be appreciated by particular reference to FIG. 10 that the relief features of the lightly engaged parts acts as a guide, so that the application of mechanical force to spline top face 280 of spline 200, when the first rail 112 is securely held and stationary, induces guided mechanical engagement between the compatible features of the first rail 112 and the spline 200. FIG. 10 thus shows the assembled state of the first rail 112 and the spline 200. Each of the first rail 112 and the second rail 114 and the spline 200 interlock in the manner described in the '478 patent (e.g., engagement between the ridge 230 and the lip 113).

Similar to the assembly 100, the assembly 300 includes the front sheet 10 with optional preformed mat 15 that extends around the peripheral edge of the front sheet 10. In addition, the image substrate 20, such as a print or photo, and the rear sheet or back plate 30 are provided and form part of the assembly 300. The rear sheet 30 can include the opaque center region 31.

Thus, unlike the assembly 100, the assembly 300 uses four (4) splines 200 to hold the layered image display structure in place.

When assembled, the splines 200 engage the first and second rails 112, 114 but due to the mitered ends of the splines 200, a small gap exists between the mitered ends of the first and second rails 112, 114. This gap extends from the outside of the corner all the way to the inside of the corner.

Figure 14:
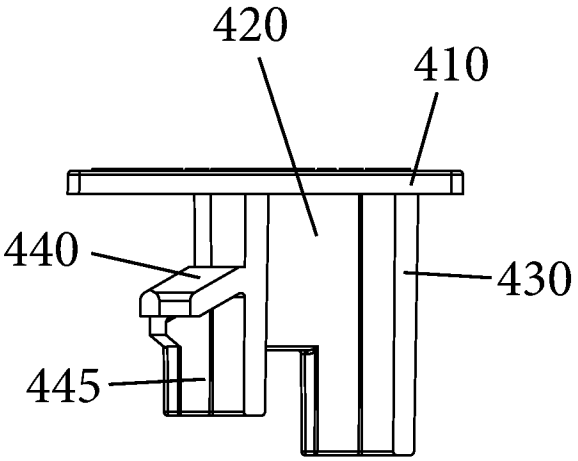
FIG. 14 is a bottom and side perspective view of the corner piece.
Figure 13:
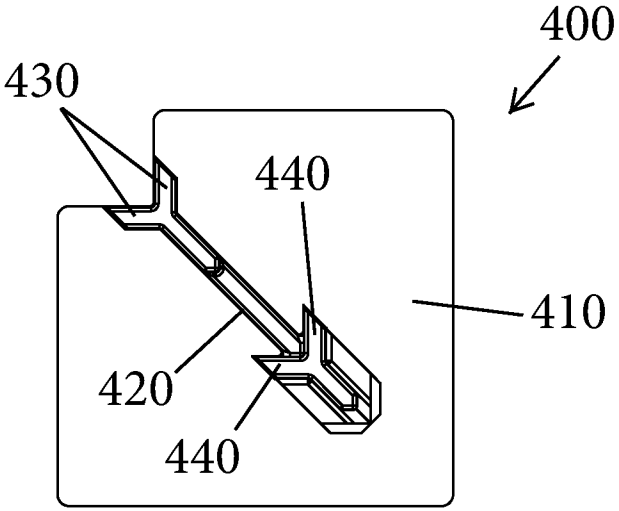
FIG. 13 is a bottom plan view of a corner piece of the assembled frame of FIG. 7.

To complete the assembly 300, a plurality of corner pieces 400 are used to finish and complete the corners of the assembly 300. FIGS. 13 and 14 illustrate exemplary corner pieces 400. The corner piece 400 includes a rear cover 410 with an underlying main guide rib 420 that extends downwardly from the rear cover 410. The main guide rib 420 is formed perpendicular to the rear cover 410. The main guide rib 420 is sized and shaped to be inserted into this gap between two mitered splines 200 in one corner.

Figure 12:
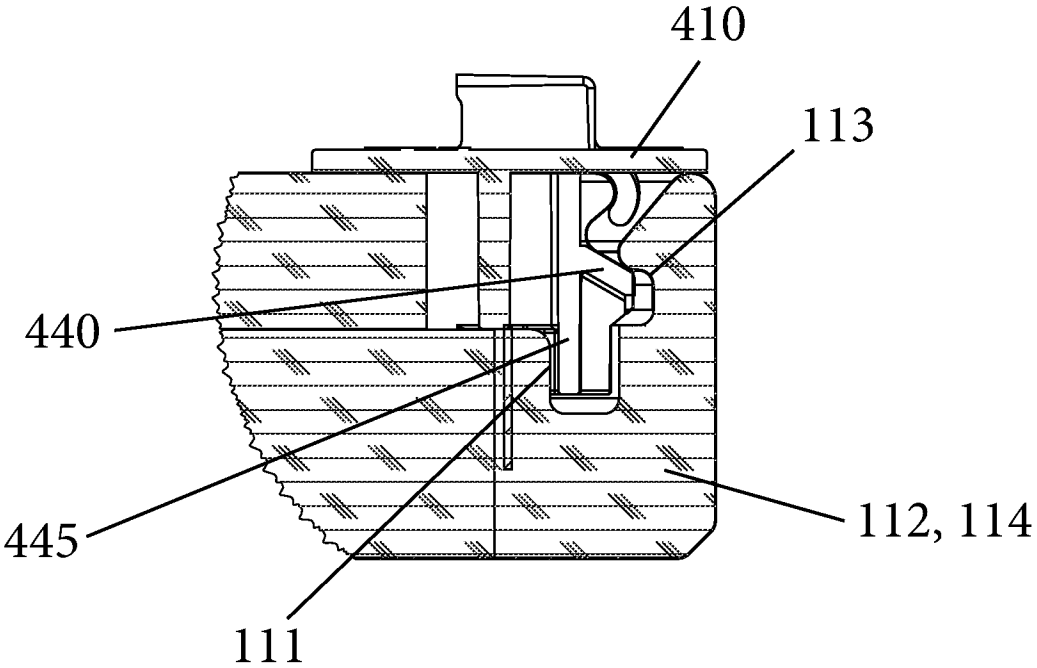
FIG. 12 is an enlarged cross-sectional view taken from FIG. 11.

The corner pieces 400 are configured to engage and lock to the first and second rails 112, 114 as shown in FIG. 12. In particular, the corner pieces 400 are configured to snap-fittingly mate to first and second rails 112, 114. Along the main guide rib 420 there are a pair of first angled ribs 430 at one end of the main guide rib 420. The angle between the pair of first angled ribs 430 is 90 degrees since this pair of first angled ribs 430 is designed to finish off the inside corner of the assembly 300. More specifically, the pair of first angled ribs 430 cover and conceal the gap between the mitered ends of the splines 200. Along the main guide rib 420 there is also a pair of second angled ribs 440. The angle between the pair of second angled ribs 440 is 90 degrees. The pair of second angled ribs 440 represent the locking part of the corner piece 400 in that the pair of second angled ribs 440 engage and snap-fit with one first rail 112 and one second rail 114 that define the corner. Each second angled rib 440 is similar to the spline engagement ridge 230 and is captured by the retainer lip 113 of the rail 112, 114 resulting in the corner piece 400 being snap-fittingly locked to the rails 112, 114 in each corner of the assembly 300.

A wall section 445 that is below the pair of second angled ribs 440 is received within dado 111.

The outer surface of the corner piece 400 is planar and smooth since it is visible along the rear of the assembly 300.

The layered image display is prepared which includes positioning and securing the image 20 to the rear face of the front sheet 10 and more particular, the image substrate 20 is secured to front sheet and when there is a mat 15, the image substrate 20 is positioned and secured to the mat 15. For example, tape can be used to secure the image substate 20 to the mat 15. The rear sheet 30 is then positioned over the rear of the image substrate 20. The opaque center region 31 covers the image substrate 20 and the mat 15. This layered image display is then inserted into the base 110 and positioned on the retaining rabbet 117 of the four rails 112, 114 that define the base 110. Next, the four splines 200 are secured to the four rails 112, 114 as described herein (e.g., by a snap-fit connection). As previously mentioned, gaps exist between the mitered ends of the rails 112, 114 in each corner of the assembly 300. The corner pieces 400 are inserted into these gaps between the mitered ends of the splines 200 with the pair of second angled ribs 440 engaging the retainer lips 113 of the mitered rails 112, 114 the define the corner. This engagement snap-fittingly locks the corner pieces 400 in place to the base 110. The pair of first angled ribs 430 complete the clean appearance of the inside of the frame and cover the gap between the mitered ends of the rails 112, 114.

In yet another aspect, the assembly 300 includes a hanger 500 that is configured to snap-fittingly engage one spline 200. The hanger 500 includes an inner wall 520 that is configured to seat against the spline top face 280 when the hanger 500 is secured to the spline 200 in a snap-fit manner. The inner wall 520 includes a plurality of curved locking tabs 510 that extend outwardly from the inner wall 520. The curved locking tabs 510 includes a first set of tabs that engage the spline backer retention lip 260 and a second set of tabs that engage the angled spline lifting face 270. The first set of tabs thus extends along one edge of the spline 200 and the second set of tabs extends along the other edge of the spline 200 to lock the hanger 500 to the spline 200. An outer wall 502 is spaced from the inner wall 520 with a space therebetween. The outer wall 502 is thus formed parallel to the inner wall 520. The outer wall 502 includes a serrated edge to permit hanging on a fastener (nail). This structure allows the hanger 500 to function as a sawtooth hanger. The snap-fit functionality of the hanger 500 allows the user to easily position the hanger 500 on the chosen spline 200 after assembling the assembly 300 and then lock it into place by pushing the hanger 500 against the spline 200 to cause a spreading apart of the curved locking tabs 510.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A frame assembly comprising:

a mitered frame base including a plurality of rail sections that are joined together in corners of the mitered frame base by a plurality of fasteners, each rail section including a first surface for receiving a layered image arrangement;

a plurality of mitered splines that are configured to snap-fittingly mate with the plurality of rail sections, each spline having a second surface that faces the first surface of one of the respective rail sections for securing the layered image arrangement between the spline and the rail section, wherein a corner gap is formed between ends of respective mitered splines in each corner of the frame assembly;

a plurality of corner pieces are received within the corner gaps to complete the frame assembly, the plurality of corner pieces snap-fittingly engaging the plurality of rails sections; and a hanger that snap-fits to one spline of the plurality of splines.

2. The frame assembly of claim 1, wherein each spline includes a spline guide ridge and a spline engagement ridge, the spline guide ridge being received within a dado formed in the respective rail section and the spline engagement ridge engaging a retainer lip of the respective rail section.

3. The frame assembly of claim 1, wherein each corner piece includes a rear cover and a main guide rib extending outwardly from the rear cover and configure for insertion into the corner gap.

4. The frame assembly of claim 1, wherein the hanger includes a plurality of locking tabs that engage first and second edges of the spline in a snap-fit manner.

5. The frame assembly of claim 4, wherein the hanger includes an inner wall the seats against a spline top face, the plurality of locking tabs includes a first set of locking tabs and a second set of locking tabs, the first set of locking tabs engaging the first edge of the spline and the second set of locking tabs engaging the second edge of the spline.

6. The frame assembly of claim 5, wherein the hanger includes an outer wall that is spaced from the inner wall, the outer wall including a serrated edge.

7. The frame assembly of claim 4, wherein each locking tab comprises a curved tab.

8. The frame assembly of claim 1, wherein the hanger comprises a sawtooth hanger.

9. The frame assembly of claim 1, wherein the hanger comprises an injection molded part.

10. A frame assembly comprising:

a mitered frame base including a plurality of rail sections that are joined together in corners of the mitered frame base by a plurality of fasteners, each rail section including a first surface for receiving a layered image arrangement;

a plurality of mitered splines that are configured to snap-fittingly mate with the plurality of rail sections, each spline having a second surface that faces the first surface of one of the respective rail sections for securing the layered image arrangement between the spline and the rail section, wherein a corner gap is formed between ends of respective mitered splines in each corner of the frame assembly; and a plurality of corner pieces are received within the corner gaps to complete the frame assembly, the plurality of corner pieces snap-fittingly engaging the plurality of rails sections;

wherein each corner piece includes a rear cover and a main guide rib extending outwardly from the rear cover and configure for insertion into the corner gap;

wherein the main guide rib includes a pair of first angled ribs and a pair of second angled ribs, the pair of first angled ribs configured to cover and conceal the corner gap along an inner face of the plurality splines, the pair of second angled ribs being configured to engage and snap-fit with two rail sections that define one corner of the frame assembly.

11. The frame assembly of claim 10, wherein an angle between the pair of first angled ribs is 90 degrees and an angle between the pair of second angled ribs is 90 degrees.

12. The frame assembly of claim 11, wherein each spline includes a spline guide ridge and a spline engagement ridge, the spline guide ridge being received within a dado formed in the respective rail section and the spline engagement ridge engaging a retainer lip of the respective rail section and wherein a wall below the pair of second angled ribs is received within the dado.

13. A frame assembly comprising:

a layered image arrangement for displaying within the frame assembly, the layered image arrangement including a front sheet having a mat along a first face thereof, an image substrate disposed against the front sheet adjacent the mat, and a rear sheet that is disposed against the image substrate, the rear sheet having an opaque center region that covers the image substrate and extends across and mat;

a mitered frame base including a plurality of rail sections that are joined together in corners of the mitered frame base by a plurality of fasteners, each rail section including a first surface for receiving the layered image arrangement;

a plurality of mitered splines that are configured to snap-fittingly mate with the plurality of rail sections, each spline having a second surface that faces the first surface of one of the respective rail sections for securing the layered image arrangement between the spline and the rail section, wherein a corner gap is formed between ends of respective mitered splines in each corner of the frame assembly; and a plurality of corner pieces are received within the corner gaps to complete the frame assembly, the plurality of corner pieces snap-fittingly engaging the plurality of rails sections;

wherein the opaque center region is formed of ink and is printed on the rear sheet that comprises a transparent sheet.

14. The frame assembly of claim 13, wherein the front sheet comprises a transparent front sheet and the mat comprises a printed mat portion formed along peripheral edges of the transparent front sheet.

15. The frame assembly of claim 13, wherein each corner piece includes a rear cover and a main guide rib extending outwardly from the rear cover and configure for insertion into the corner gap.

16. The frame assembly of claim 15, wherein the main guide rib includes a pair of first angled ribs and a pair of second angled ribs, the pair of first angled ribs configured to cover and conceal the corner gap along an inner face of the plurality splines, the pair of second angled ribs being configured to engage and snap-fit with two rail sections that define one corner of the frame assembly.

17. The frame assembly of claim 16, wherein an angle between the pair of first angled ribs is 90 degrees and an angle between the pair of second angled ribs is 90 degrees.

18. The frame assembly of claim 17, wherein each spline includes a spline guide ridge and a spline engagement ridge, the spline guide ridge being received within a dado formed in the respective rail section and the spline engagement ridge engaging a retainer lip of the respective rail section and wherein a wall below the pair of second angled ribs is received within the dado.

19. The frame assembly of claim 13, further including a hanger that snap-fits to one spline of the plurality of splines.

20. The frame assembly of claim 19, wherein the hanger includes a plurality of locking tabs that engage first and second edges of the spline in a snap-fit manner.

21. The frame assembly of claim 20, wherein the hanger includes an inner wall the seats against a spline top face, the plurality of locking tabs includes a first set of locking tabs and a second set of locking tabs, the first set of locking tabs engaging the first edge of the spline and the second set of locking tabs engaging the second edge of the spline.

22. The frame assembly of claim 21, wherein each locking tab comprises a curved tab.

23. The frame assembly of claim 22, wherein the hanger includes an outer wall that is spaced from the inner wall, the outer wall including a serrated edge.

24. A frame assembly comprising:

a mitered frame base including a plurality of rail sections that are joined together in corners of the mitered frame base by a plurality of fasteners, the plurality of rail sections including a pair of opposing first rail sections and a pair of opposing second rail sections, each first rail section including a first surface for receiving a layered image arrangement and each second rail section including a channel formed along an inner face, wherein the first surface and the channel are coplanar; and a pair of splines that are configured to snap-fittingly mate with the pair of first rail sections, each spline having a second surface that faces the first surface of one of the respective first rail sections for securing the layered image arrangement between the spline and the rail section.

* * * * *